United States Patent [19]

Roccaforte

[11] 4,160,502

[45] Jul. 10, 1979

[54] PLATFORM CARTON

[75] Inventor: Harry I. Roccaforte, Western Springs, Ill.

[73] Assignee: Champion International Corporation, Stamford, Conn.

[21] Appl. No.: 898,468

[22] Filed: Apr. 20, 1978

[51] Int. Cl.[2] ..... B65D 5/50

[52] U.S. Cl. ..... 206/45.14; 206/45; 206/486

[58] Field of Search ..... 206/45, 45.14, 45.19, 206/419, 420, 476, 486, 490, 461, 589; 229/39 B, 44 R

[56] References Cited

U.S. PATENT DOCUMENTS

| | | | |
|---|---|---|---|
| 1,901,532 | 3/1933 | Powell et al. | 206/45.14 |
| 2,781,898 | 2/1957 | Desmond et al. | 206/45.19 |
| 2,939,622 | 6/1960 | D'Ippolito | 229/39 B |
| 3,089,631 | 5/1963 | Tyrseck et al. | 206/45.19 |
| 3,921,895 | 11/1975 | Ziche | 229/39 B |
| 4,037,717 | 7/1977 | Roccaforte | 206/45.14 |

FOREIGN PATENT DOCUMENTS

| | | | |
|---|---|---|---|
| 759933 | 2/1934 | France | 229/39 B |

*Primary Examiner*—Herbert F. Ross
*Attorney, Agent, or Firm*—Evelyn M. Sommer

[57] ABSTRACT

A platform carton has front and back panels connected by side panels. Panels for forming an article-receiving platform within the carton include a base panel extending from the bottom of the front panel, a riser panel formed by a continuation of the base panel, an apertured platform panel continuing from the riser panel and a glue flap at the opposite edge of the platform panel. The base panel extends from the front panel to the back panel while the riser panel lays against the inner surface of the back panel. The platform panel extends forward from the riser panel toward the front panel, to which it is secured by the glue flap. The platform panel and the base panel are both parallel to the top and bottom edges of the carton. A top cover flap connected to the back panel can be folded down over the top of the carton while a bottom cover flap extending from the bottom of the back panel can be folded upward to cover the base panel.

6 Claims, 9 Drawing Figures

PLATFORM CARTON

BACKGROUND OF THE INVENTION

The present invention relates to a carton and more particularly to a one-piece carton having an internal apertured article-receiving platform.

A platform carton is generally defined as any carton having an internal member with one or more openings for receiving and positioning articles to be shipped and usually marketed without removal from the carton. Platform cartons are typically used for shipping and/or marketing fragile items such as light bulbs or ampoules.

In one known type of platform carton, the platform insert is fabricated separately and simply fitted into a standard rectangular carton or box. The insert may or may not be secured by adhesive to the standard box.

Attempts have been made to fabricate both the platform and the other carton from a one piece blank. However, all known solutions have posed problems relating to formation of the blank, application of the necessary adhesive strips to the blank and subsequent erection of the box.

SUMMARY OF THE INVENTION

These problems are overcome by the present invention, which is a carton which can be produced at relatively low cost from a single piece of sheet material, such as paperboard or the like, and which can be fabricated and erected without difficulty.

According to the present invention, a platform carton has a pair of first panels and a pair of second panels connecting the first panels to form a polygonal-section tube. A platform is erected within the tube from three main integral panels; namely, a base panel which is connected to one edge of one of the first panels at a fold line, a riser panel which continues from and is connected to the base panel and a platform panel which continues from and is connected to the riser panel. The platform panel terminates in a glue flap. These sections form a generally U-shaped member with the base panel and the platform panel bridging the space defined by the first and second pair of panels while the riser panel lays against one panel of the first pair. The glue flap is used to secure the platform panel to the other panel of the first pair.

BRIEF DESCRIPTION OF THE DRAWINGS

While the specification concludes with claims particularly pointing out and distinctly claiming that which is regarded as the present invention, further details of a preferred embodiment of the invention may be more readily ascertained from the following detailed description when read in conjunction with the accompanying drawings wherein:

DESCRIPTION OF A PREFERRED EMBODIMENT

Figure 1:
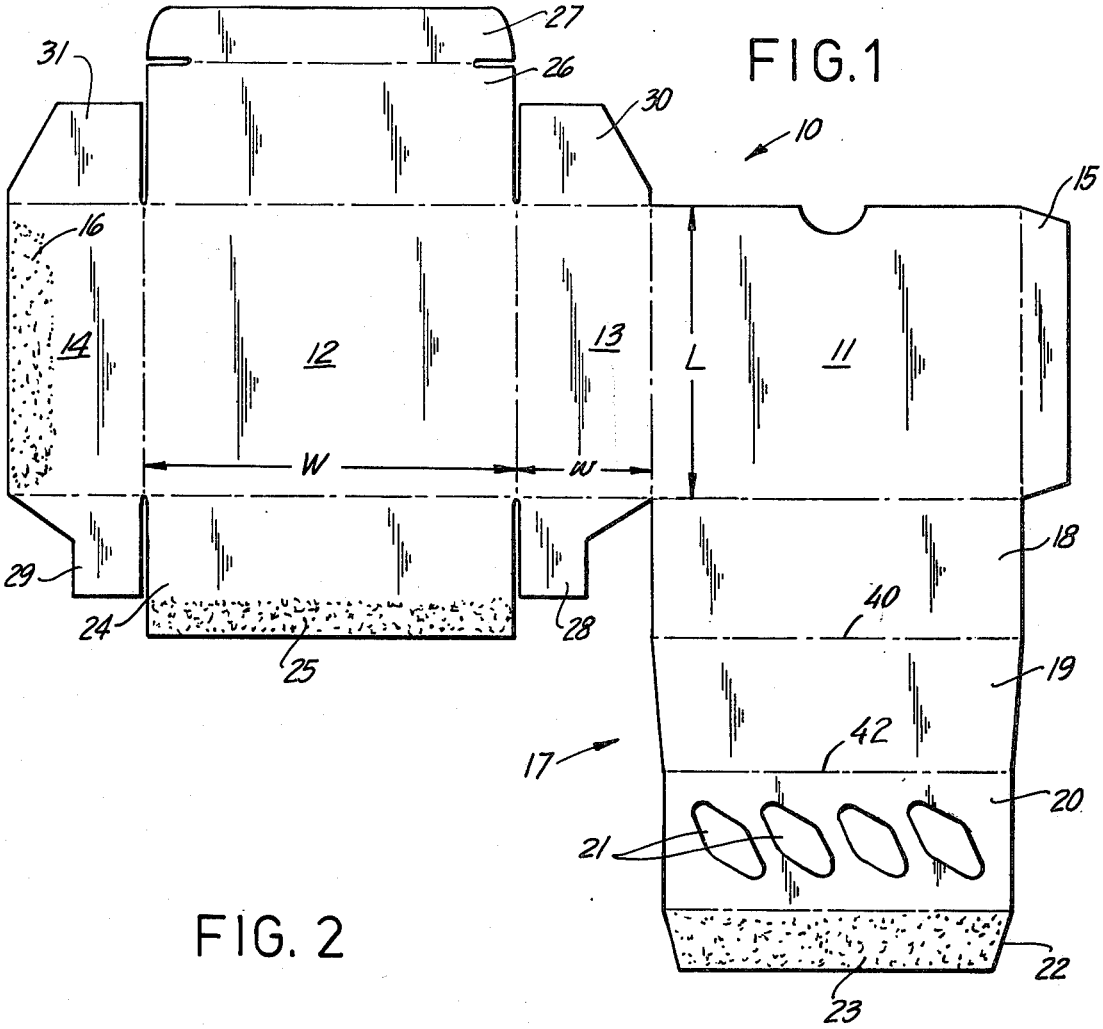
FIG. 1 is a plan view of a blank for forming a carton in accordance with this invention.

As shown in FIG. 1 a carton constructed in accordance with the present invention is formed from a one piece blank 10 stamped or otherwise shaped from paperboard or other suitable sheet material. The blank 10 has four side wall panels including a front panel 11 and an equally large back panel 12. The distance between the upper and lower edges of these panels is defined as a length L while the distance between their side edges is defined as a width W. The front and back panels alternate with a pair of side panels 13 and 14 which are of the same length L but which are substantially narrower than panels 11 and 12 in the illustrated embodiment, having a width w. The free side edge of the front panel 11 is provided with a trapezoidal glue flap 15 which can engage a corresponding glue strip 16 at the free side edge of the side panel 14 to form a tube having a rectangular cross section.

An article-receiving platform may be erected within this tube by means of set 17 of platform-forming panels extending from the bottom edge of front panel 11. The set 17 includes a base panel 18, a riser panel 19 and a platform panel 20. The base panel 18 is of the same width W as the front and back panels 11 and 12 and of a length equal to the width w of the side panels 13 and 14. The riser panel 19 is a continuation of the base panel 18, being connected to it at a fold line 40. Riser panel 19 is generally trapezoidal with tapered edges which converge slightly from the fold line 40. The vertical dimension of riser panel 19 determines the spacing between the base panel 18 and platform panel 20 which extends from the riser panel 19 at a fold line 42. The platform panel 20 terminates at glue flap 22 having a coating 23 of a suitable adhesive. For purposes of illustration, the platform panel 20 is shown with four equispaced diamond-shaped apertures 21. The number and shape of the apertures will vary as a function as the size and shape of the articles to be packed within the carton.

The back panel 12 has a bottom cover flap 24 extending from its lower edge. Flap 24 is approximately as wide as back panel 12 and as long as the width of the side panels 13 and 14. A glue strip 25 is formed on the free edge of this flap 24.

A top cover flap 26 extends from the top edge of back panel 12. Flap 26 has the same dimensions as the bottom cover flap 24. A tuck flap 27 with rounded edges extends from the free edge of top cover flap 26.

The side panels 13 and 14 carry, respectively, relatively small five-sided bottom flaps 28 and 29. At their upper edges, panels 13 and 14 carry, respectively, trapezoidal dust flaps 30 and 31.

After the blank 10 has been shaped and the necessary fold lines have been formed, it can be erected in the manner indicated below to form a platform carton.

It should first be noted that all of the glue strips 16, 23 and 25 are on the same face of the blank 10 for in-line processing of the blank 10.

Figure 2:
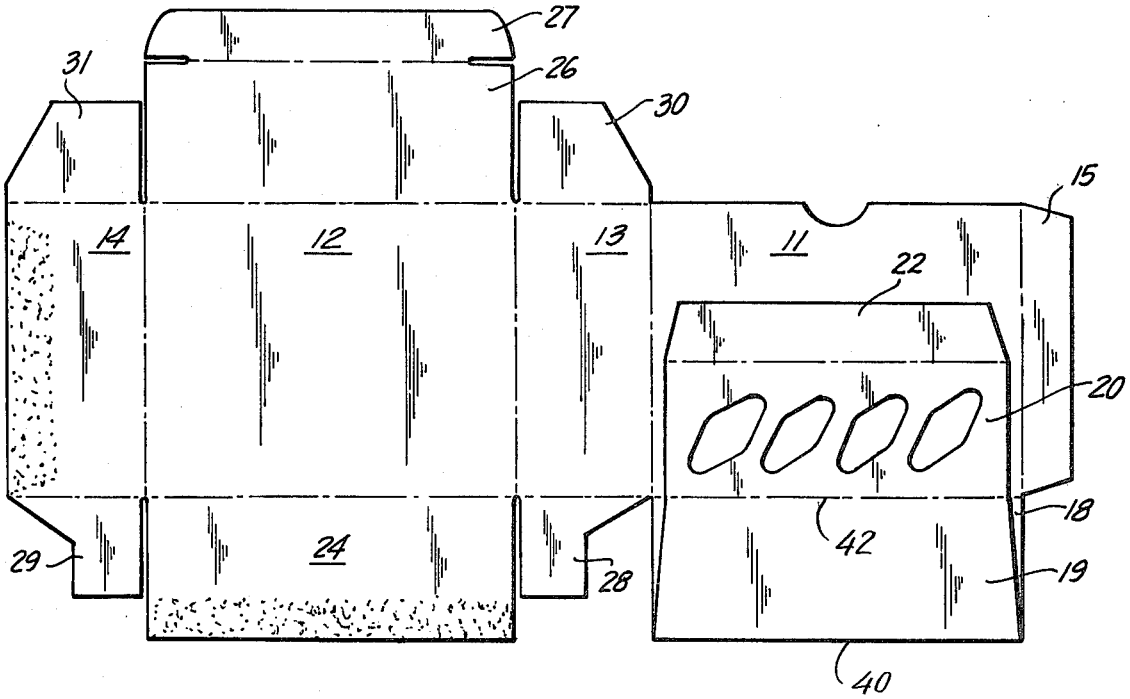
FIGS. 2 and 3 are plan views showing the carton in two stages as it is being folded.
Figure 3:
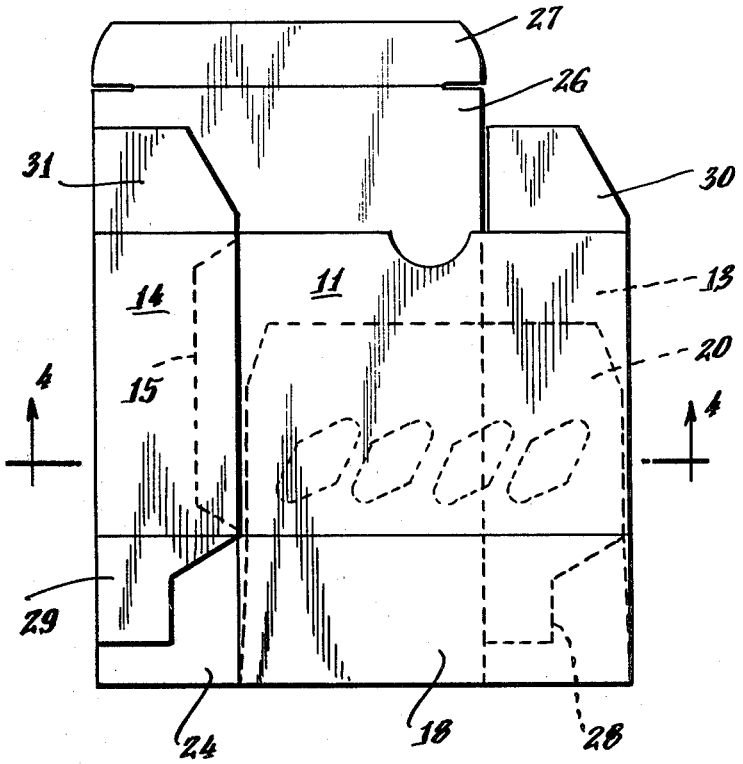
Figure 4:
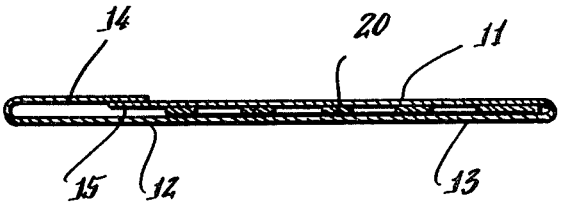
FIG. 4 is a cross sectional view taken along line IV—IV of FIG. 3.

First, the section of the blank having riser panel 19, platform panel 20 and glue flap 22 is folded upward about fold line 40 as indicated in FIG. 2 to bring the glue flap 22 into engagement with the inner surface of front panel 11 at a point about halfway up the panel. Then, as shown in FIGS. 3 and 4, the panels 11, 12 13 and 14 are bent about the fold line between panels 11 and 13 to sandwich the riser panel 19 and platform panel 20 between front panel 11 and side panel 14 on one side and back panel 12 and side panel 13 on the other side. The glue flap 15 is secured at this time to the adhesive strip 16 to form a collapsed tube from panels 11, 12, 13 and 14. As shown in FIG. 4 the partially erected blank is still substantially flat at this stage. If the carton is to be shipped in this collapsed condition, the latex strip 25 should either be of a reactivatable type or should not be applied until the carton is to be fully erected.

Figure 5:
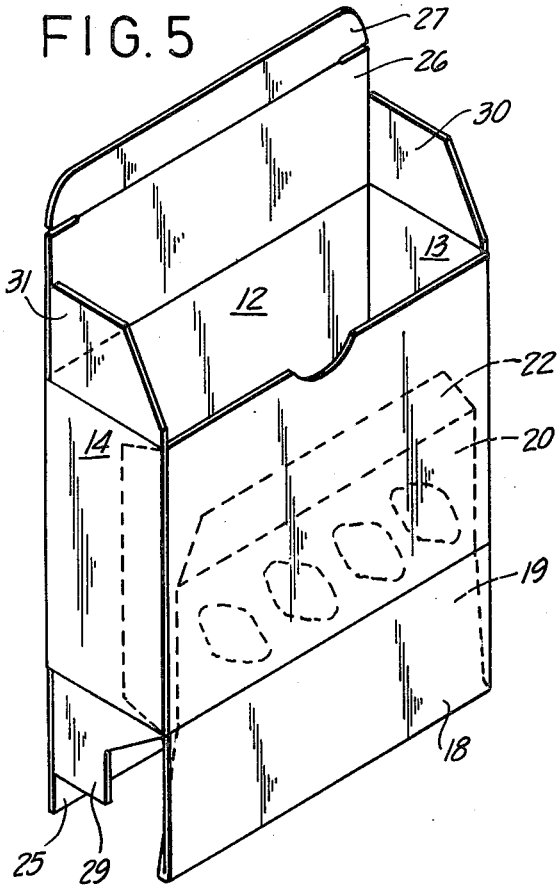
FIGS. 5 and 6 are perspective views showing the carton in two later stages of being formed.

FIG. 5 shows the next step in the carton forming process. The panels 11 and 12 are pulled apart to form a rectangular tube defined by the panels 11–14.

Figure 7:
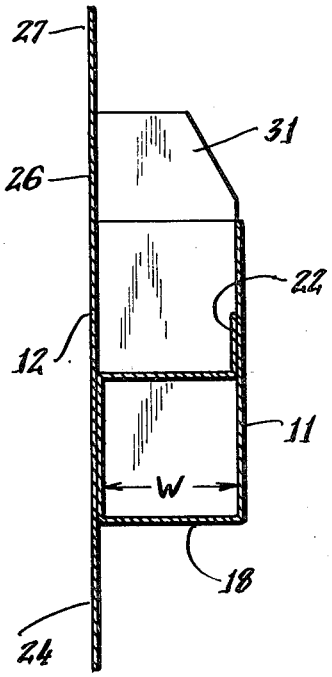
FIG. 7 is a cross sectional view taken along line VII—VII of FIG. 6.
Figure 6:
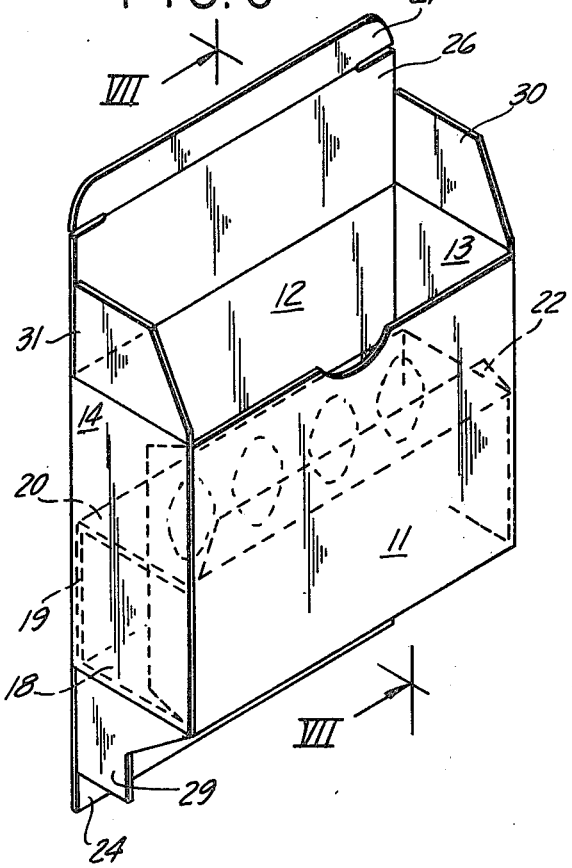

Thereafter, as shown in FIGS. 6 and 7, the platform forming panels are folded into the tube formed by the panels 11–14 with base panel 18 extending from the bottom edge of front panel 11 to the bottom edge of back panel 12 while riser panel 19 extends upwardly along the lower half of the back panel 12. Platform panel 20 being secured to front panel 11 by means of glue flap 22 bridges the space between back panel 12 and front panel 11 at a height above base panel 18 which is determined by the height of riser panel 19. Since both base panel 18 and platform 20 completely occupy the interior rectangular section of the tube, these panels reinforce and rigidify the tube.

Figure 8:
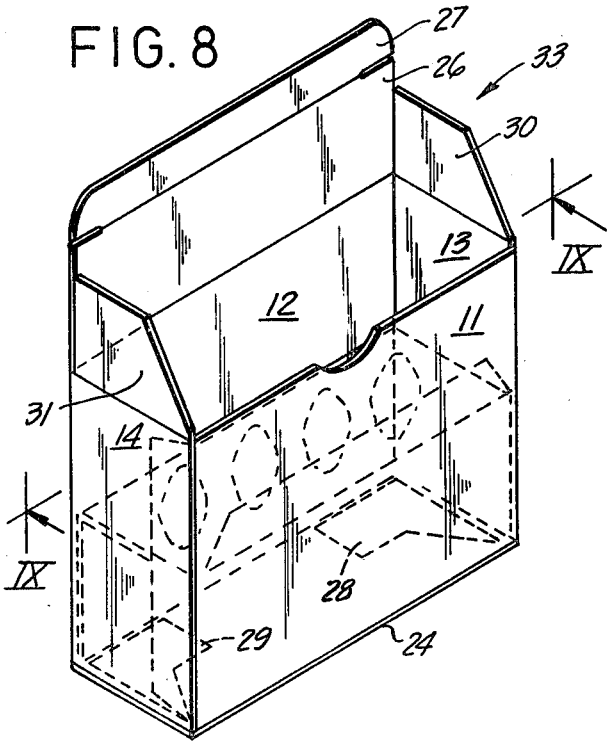
FIG. 8 is a perspective view showing the fully erected carton in accordance with this invention.
Figure 9:
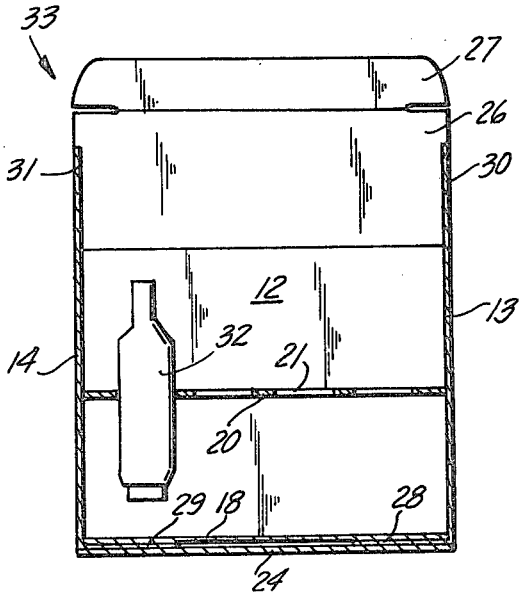
FIG. 9 is a cross sectional view taken along line IX—IX of FIG. 8.

Then, as shown in FIGS. 8 and 9, the bottom flaps 28 and 29 are folded inward against the base panel 18 before bottom cover flap 25 is folded over to cover flaps 28 and 29 and base panel 18. Bottom cover flap is secured by adhesive 25 to the surface of the base panel 18 adjacent the front panel 11 so as to form a finished carton 33 with its top open.

A plurality of articles, such as plastic ampoule or tube 32, may be inserted into the apertures 21 of platform panel 20. Each article will be securely supported inside the carton 33 and will be separated from other articles by spacing the apertures in platform panel 20 to avoid breakage-inducing contact. Additionally, the platform structure rigidifies and strengthens the carton to minimize accidental crushing of the carton which might result in damage to the contents.

Once the carton has been loaded, dust flaps 30 and 31 are folded in, top cover flap 26 is folded forward and the tuck flap 27 is fitted into the space between front panel 11 and the edges of dust flaps 30 and 31 in the conventional manner.

While there has been described what is considered to be a preferred embodiment of the invention, variations and modifications therein will occur to those skilled in the art once they become acquainted with the basic concepts of the invention. For example, although reference has been made above to top, side and bottom edges of various panels as a matter of convenience, it is to be understood that the carton can be oriented in any direction. Furthermore, although base panel 18 and platform panel 20 are shown to be of substantially the same width as the front and back panels 11 and 12, it is entirely within the scope of the invention to make these panels shorter so that the platform structure does not extend the length of the inside of the carton. Similarly, the length of riser panel 19 may be varied depending on the type of article to be carried within the carton. Therefore, it is intended that the appended claims shall be construed to include all such variations and modifications as fall within the true spirit and scope of the invention.

What is claimed is:

1. A platform carton for fragile articles comprising:
generally parallel front and back panels, each having a top edge and a bottom edge;
generally parallel side panels connecting said front and back panels, each of said side panels having a top edge and a bottom edge;
a top cover flap extending from the top edge of said back panel, said top cover flap terminating in a tuck flap, and two side flaps, each extending from a top edge of one of said side panels;
a platform section bridging the space between said front and back panels, said platform section further comprising an integral arrangement of:
a base panel having one edge connected to said bottom edge of said front panel at a fold line, said base panel extending toward said bottom edge of said back panel,
a riser panel connected to the opposite edge of said base panel, said riser panel extending upwardly along the inner surface of said back panel,
a platform panel connected along one edge to said riser panel, said platform panel extending toward said front panel, said platform panel having at least one aperture therein for receiving a fragile article to be firmly supported by the platform carton, and
a glue flap extending from the opposite edge of said platform panel toward the top edge of said front panel, said glue flap being bonded to the inside surface of said front panel; and
a bottom cover flap extending from the bottom edge of said back panel, said bottom cover flap including an adhesive strip adjacent its free edge for securing said flap to said base panel.

2. The carton defined in claim 1, wherein all of said panels are included in a one piece blank of a suitable sheet material.

3. The carton defined in claim 1, wherein all of said panels are substantially rectangular.

4. The carton defined in claim 1, wherein said base panel and said platform panel occupy the space defined by said front panel, said back panel and said side panels.

5. The carton defined in claim 1 further comprising a pair of bottom flaps, each extending from a bottom edge of one of said side flaps and being sandwiched between the base panel and the bottom cover flap in the erected carton.

6. A platform carton for fragile articles as in claim 1 wherein said platform panel includes a plurality of apertures for accommodating a corresponding plurality of fragile articles, said apertures being in spaced relationship in the platform panel to avoid breakage-inducing contact.

* * * * *